US012263975B2

(12) United States Patent
Arnold et al.

(10) Patent No.: US 12,263,975 B2
(45) Date of Patent: Apr. 1, 2025

(54) METHOD OF AUTOMATING FILLING AND PACKAGING OF FLAT RETENTION INSERTS

(71) Applicant: ARNOLD PACKAGING COMPANY, Sparrows Point, MD (US)

(72) Inventors: Michael W. Arnold, Baltimore, MD (US); Cailin D. Mazan, Annapolis, MD (US); Kevin R. McHenry, Fallston, MD (US)

(73) Assignee: ARNOLD PACKAGING COMPANY, Sparrows Point, MD (US)

( * ) Notice: Subject to any disclaimer, the term of this patent is extended or adjusted under 35 U.S.C. 154(b) by 0 days.

(21) Appl. No.: 18/242,562

(22) Filed: Sep. 6, 2023

(65) Prior Publication Data

US 2025/0074642 A1 Mar. 6, 2025

(51) Int. Cl.

| | |
|---|---|
| ***B65B 41/06*** | (2006.01) |
| ***B65B 43/28*** | (2006.01) |
| ***B65B 43/44*** | (2006.01) |
| ***B65B 55/20*** | (2006.01) |

(52) U.S. Cl.

CPC ..... *B65B 41/06* (2013.01); *B65B 43/285* (2013.01); *B65B 43/44* (2013.01); *B65B 55/20* (2013.01)

(58) Field of Classification Search

CPC ..... B65B 23/00; B65B 55/20; B65B 65/003; B65B 5/024; B65B 43/126; B65B 43/08; B65B 43/10; B65B 43/145; B65B 43/185; B65B 43/265; B65B 43/285; B65B 41/06; B65B 43/144; B65B 2220/02; B65D 5/5028; B65D 81/07

USPC ..... 53/441, 457, 458, 472, 139.5, 556, 564, 53/574, 575; 206/583, 521, 594

See application file for complete search history.

(56) References Cited

U.S. PATENT DOCUMENTS

| | | | | |
|---|---|---|---|---|
| 5,323,896 | A * | 6/1994 | Jones | B65D 5/5028 206/583 |
| 6,148,590 | A * | 11/2000 | Ridgeway | B65D 81/075 206/583 |
| 6,913,147 | B2 | 7/2005 | Mueller et al. | |
| 7,694,496 | B2 * | 4/2010 | Keiger | B65D 75/305 53/441 |
| 2008/0142407 | A1 * | 6/2008 | Moore | B65B 53/063 206/583 |
| 2011/0240515 | A1 * | 10/2011 | Ridgeway | B65D 5/5028 53/472 |
| 2018/0141700 | A1 * | 5/2018 | Ridgeway | B65B 49/08 |

* cited by examiner

*Primary Examiner* — Stephen F. Gerrity
*Assistant Examiner* — Linda J Hodge
(74) *Attorney, Agent, or Firm* — H. Jay Spiegel

(57) ABSTRACT

A method of automating filling and packaging of flat retention inserts is conducted on an assembly line that includes three stations. A first station includes a magazine for storing a plurality of stacked flat retention inserts. A second station includes a folding mechanism configured to fold the flat retention insert into various orientations to facilitate retention of a product. A third station holds a shipping container where the flat retention insert with a product held therein may be placed for shipment. Actuators with rams are utilized to remove a flat retention insert from the magazine, convey it to the folding mechanism, facilitate insertion of a product and conveyance of the product and flat retention insert to the shipping container.

20 Claims, 23 Drawing Sheets

METHOD OF AUTOMATING FILLING AND PACKAGING OF FLAT RETENTION INSERTS

BACKGROUND OF THE INVENTION

The present invention relates to a method of automating filling and packaging of flat retention inserts.

Flat retention inserts are known in the art. U.S. Pat. No. 6,913,147 to Mueller et al. discloses such a device. As can be seen in the Mueller et al. patent, a flat retention insert includes a retention frame that may be made, for example, of paperboard, cardboard or corrugated cardboard, and a film attached to the frame as described in greater detail hereinbelow.

FIGS. 1-10 show details of a flat retention insert on which the method of the present invention is practiced. With reference first to FIGS. 1 and 2, a flat retention insert is generally designated by the reference numeral 10 and is seen to include a body 11 made of a material such as cardboard having a film 13 adhered thereto along lines 24 and 26 for the thickness of the glue line. At each end 19 and 21, the film 13 is not adhered to the frame 11 so that, as will be described in greater detail hereinafter, manipulation of portions of the frame 11 allow the openings 19 and 21 to be opened and then permit a product to be placed between the film 13 and the frame 11.

With further reference to FIGS. 1 and 2, flaps 23, 25, 27, and 29 are provided on the frame 11. With reference now to FIG. 3, it is seen that when the flaps 23 and 25 are bent upwardly, this causes the film 13 to be bent in a manner creating openings 31 and 33 at each end thereof creating a chamber 35 clearly shown in FIG. 4. With reference to FIGS. 4 and 5, the chamber 35 created by bending up the flaps 23 and 25 allows insertion of a product 1 into the chamber 35. The flaps 23 and 25 are bent upward at the score lines 15 and 17.

With reference to FIGS. 6 and 7, it is seen that the flaps 23 and 25 may be pivoted downwardly to stretch the film 13 over the product 1 which assists in retaining the product 1 within the chamber 35 in which the product 1 has been placed. FIG. 8 shows further bending of the flaps 23 and 25 which further stretches the film 13 and further retains the product 1 within the chamber 35.

FIGS. 9 and 10 show the flaps 27 and 29 bent upward to cover the openings formed at each end of the film 13 by the previous upward bending of the flaps 23 and 25 which are now underneath the middle of the frame 11.

In the configuration of the insert 10 shown in particular in FIG. 10, it may be placed within a shipping container and shipped to a customer. As should be understood by those of ordinary skill in the art, the sequences of manipulations of the flat retention insert illustrated in FIGS. 1-10 have, to this time, been accomplished manually. A worker or operator is required to lift the flaps of the retention frame insert 10 to release the tension on the film 13 and create the openings 19 and 21. After the product 1 is inserted, the operator folds the flaps 23 and 25 under the body 11 of the insert as shown in particular in FIGS. 6-8 to apply tension to the film 13 to hold the product 1 in place.

Applicants have found that the process described above and with reference to FIGS. 1-10 is extremely slow and can result in repetitive use injuries to operators. Higher profile products are particularly challenging to package as the folding operations are more difficult and can actually cause the structure of the insert 10 to fail or, sometimes, false scores are created that cause the packaging to fail or no longer become compatible with the shipping container specifically designed to receive the product or products as located within the insert 10. The present invention is devised to overcome these deficiencies in manually packaging by automating the operations to increase efficiency, reduce costs, reduce injuries to people, and enhance profitability. It is with these goals in mind that the present invention was developed.

SUMMARY OF THE INVENTION

The present invention relates to a method of automating filling and packaging of flat retention inserts. The present invention includes the following interrelated objects, aspects, and features:

(1) As explained in the BACKGROUND OF THE INVENTION section supra, the present invention is intended to automate the manual operations shown in FIGS. 1-10.

(2) An assembly line is created which includes at least three stations for operation of the inventive method. A first station includes a magazine for storing a plurality of stacked flat retention inserts. A second station includes a mechanism facilitating the folding of a pair of flaps of a flat retention insert as well as insertion of a product underneath the film 13 thereof. A third station includes a mechanism including rollers that facilitate the folding of flaps as well as where a shipping container is located where the flat retention insert with a product contained therein may be placed for shipping.

(3) At the first station, a magazine is provided where a stack of flat retention inserts is placed. A first actuator may be indexed to be located above this magazine and includes a ram that may be reciprocated from a location above the magazine to a location where a gripping mechanism preferably comprising suction cups located at its lower distal end may engage the top flat retention insert, whereupon vacuum is applied to the suction cups to adhere them to the top flat retention insert. Then, this actuator ram may be reciprocated upwardly to lift the top flat retention insert above the stack of inserts located in the magazine.

(4) The actuator with the flat retention insert adhered thereto by suction may then be indexed laterally to the second station. At that location, the actuator ram may lower the flat retention insert until it engages a folding mechanism which mechanically replicates all the folding steps shown and described with reference to FIGS. 3-10.

(5) After the folding step shown in FIG. 3, the product may be placed within the chamber 35 either manually or mechanically as desired.

(6) Once the folding mechanism has accomplished some of the folds and the product is contained within the flat retention insert, the folding mechanism retains the flat retention insert in place and the first actuator is raised up and then laterally shifted out from hovering over the folding mechanism while at the same time a second actuator is moved into place over the folding mechanism. At the same time, the ram of the first actuator extends to lift a plate of the folding mechanism to the top of the frame to meet an end effector. The second actuator includes a pick and place end which may then be lowered by a ram to surround the flat retention insert with the product therewithin and secure itself to the flat retention insert.

(7) At that juncture, the pick and place end of arm tooling is raised by a ram with the flat retention insert and product therewithin and then laterally moves to the third station where a shipping container is located. Then, it is lowered through a frame where rollers complete the folding process.

Box locating plows are actuated to secure the shipping container in place. The ram then lowers the flat retention insert and product into the shipping container. Then, the pick and place end of arm tooling releases the flat retention insert and product and the shipping container is sealed and moved to a location where it may be shipped.

(8) In this way, the flat retention insert has been manipulated to open the chamber 35, permit insertion of a product therewithin, and move the product within the flat retention insert to a location where it is placed in a shipping container with minimal human interaction. At that point, the first mentioned actuator is lowered into the magazine to retrieve the next flat retention insert and the process is repeated over and over again.

As such, it is a first object of the present invention to provide a method of automating the filling and packaging of flat retention inserts.

It is a further object of the present invention to provide such a method in which a magazine is filled with flat retention inserts and a vertical pick and place actuator is manipulated vertically and through the use of suction to lift a flat retention insert from the magazine.

It is a yet further object of the present invention to provide such a method in which the vertical pick and place actuator is then indexed laterally to a location where a folding mechanism is located and the vertical pick and place actuator is lowered to lower the flat retention insert into the folding mechanism where folds are created and a product is inserted therewithin.

It is a still further object of the present invention to provide such a method which when a product is placed within the chamber of the flat retention insert, another vertical pick and place actuator is aligned above it, lowered over it, and secures the flat retention insert with the product therewithin for further manipulation.

It is a yet further object of the present invention to provide such a method in which the second vertical pick and place actuator is then moved vertically and then laterally and then lowers the flat retention insert into a shipping container for sealing and shipping.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

FIGS. 1-10 were described in the Background of the Invention concerning the flat retention insert for which automation of its filling and packaging comprise the present invention.

Figure 11:
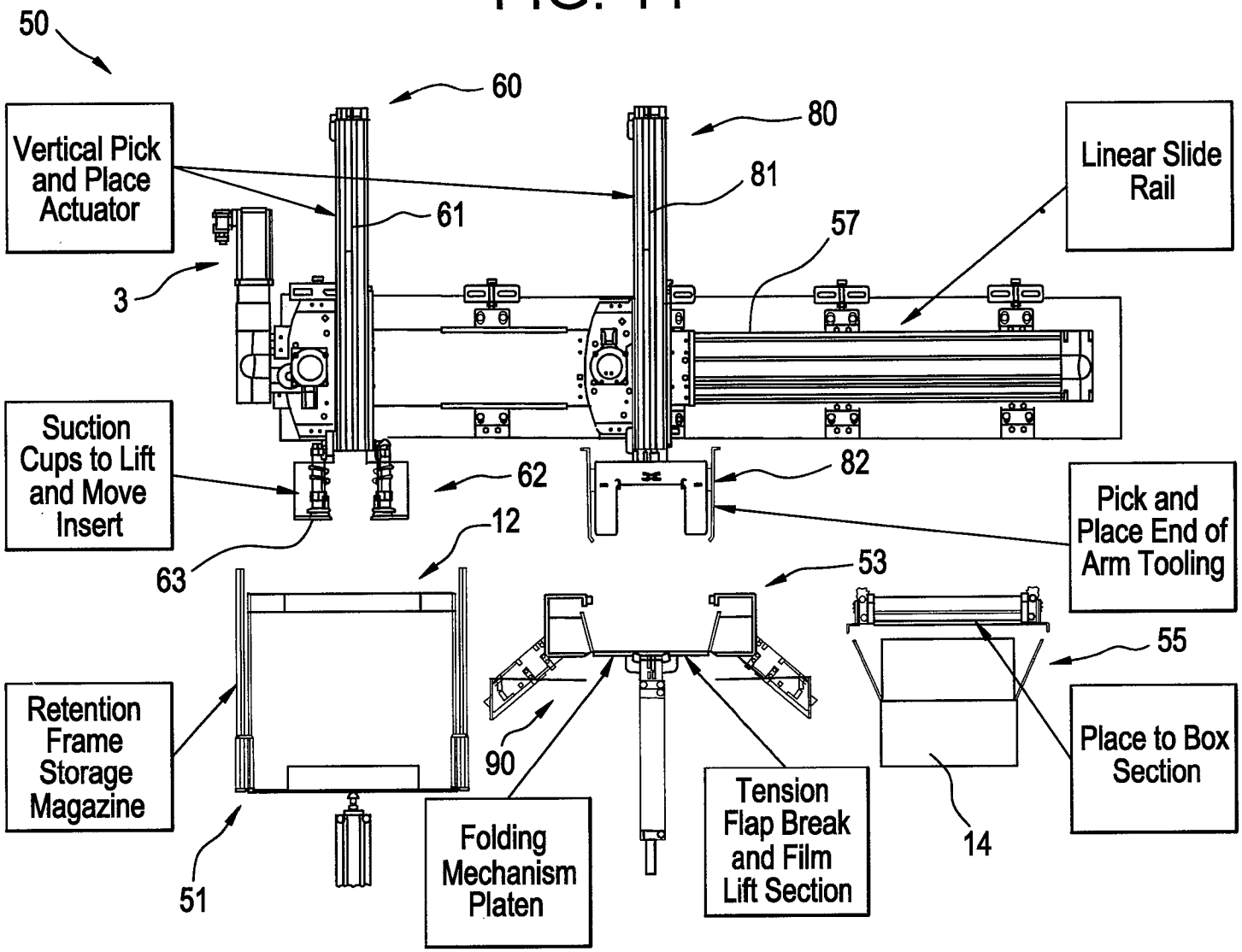
FIG. 11 shows a schematic representation of the assembly line incorporated into the present invention and utilized to practice the inventive method.

Now, with reference to FIGS. 11-26, the machinery for operating the inventive method and the inventive method will now be described. With reference first to FIG. 11, it is seen that an assembly line is generally designated by the reference numeral 50. The assembly line includes a first station having a magazine 51 which is configured to receive a stack 12 of flat retention inserts 10. Adjacent the magazine is a second station having an apparatus 53 including components and structures designed to facilitate folding of flat retention inserts in the operation of the inventive method. To the right of the apparatus 53 is a third station with an implement 55 which supports a shipping container 14 into which a flat retention insert 10 with a product 1 contained therein will be placed.

With further reference to FIG. 11, there are two vertical pick and place actuators 60 and 80 which are mounted on a linear slide rail 57 for movement in the left-hand and right-hand directions in the view of FIG. 11 in manners well understood by those skilled in the art. In particular, the actuator 60 and the actuator 80 are fixed to the linear slide rail 57 so that it may be operated to move the actuators 60 and 80 leftward and rightward in the view of FIG. 11. A motor may be employed to operate the linear slide rail 57.

The actuator 60 includes a ram 61 which may move vertically up and down in the view of FIG. 11 while the actuator 80 includes a ram 81 that may move up and downward in the view of FIG. 11.

The distal end of the ram 61 has a suction cup device 62 mounted thereon with a plurality of vacuum operated suction cups 63 which may be utilized to engage the top flat retention insert 10 located within the magazine 51 so that it may be lifted out of the magazine in practicing the method of the present invention. The suction cups 63 are fluidly connected to a source of vacuum.

The ram 81 includes a pick and place end of arm tooling 82 which is sized and configured to enclose a flat retention insert 10 which contains a product 1 so that the flat retention insert and the product may be lifted from the folding mechanism 90 and indexed by the slide rail 57 to a location above the container 14.

The linear slide rail may be moved through use of a motor 3 (FIG. 11) or by hand in any suitable manner. Motor operation is preferred so that the method may be automated.

Figure 12A:
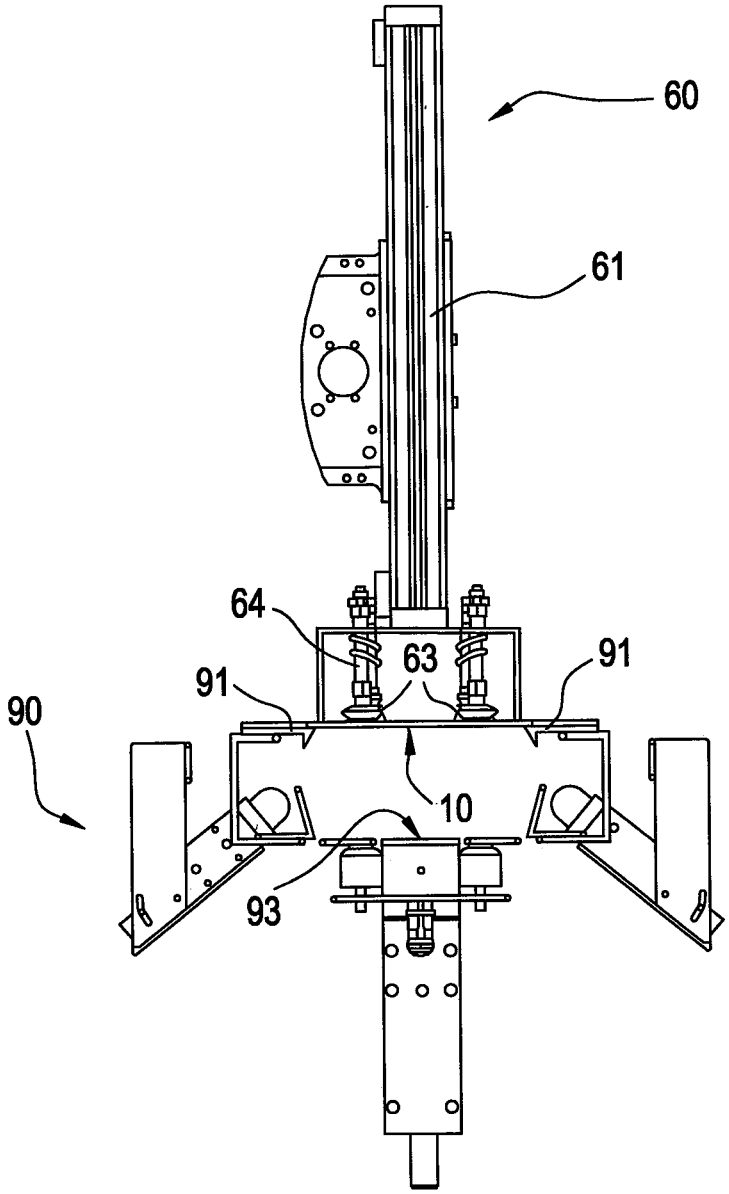
FIG. 12*a* shows a close-up end view of the portion of the assembly line utilized to fold the flat retention insert and insert a product therein.
Figure 12B:
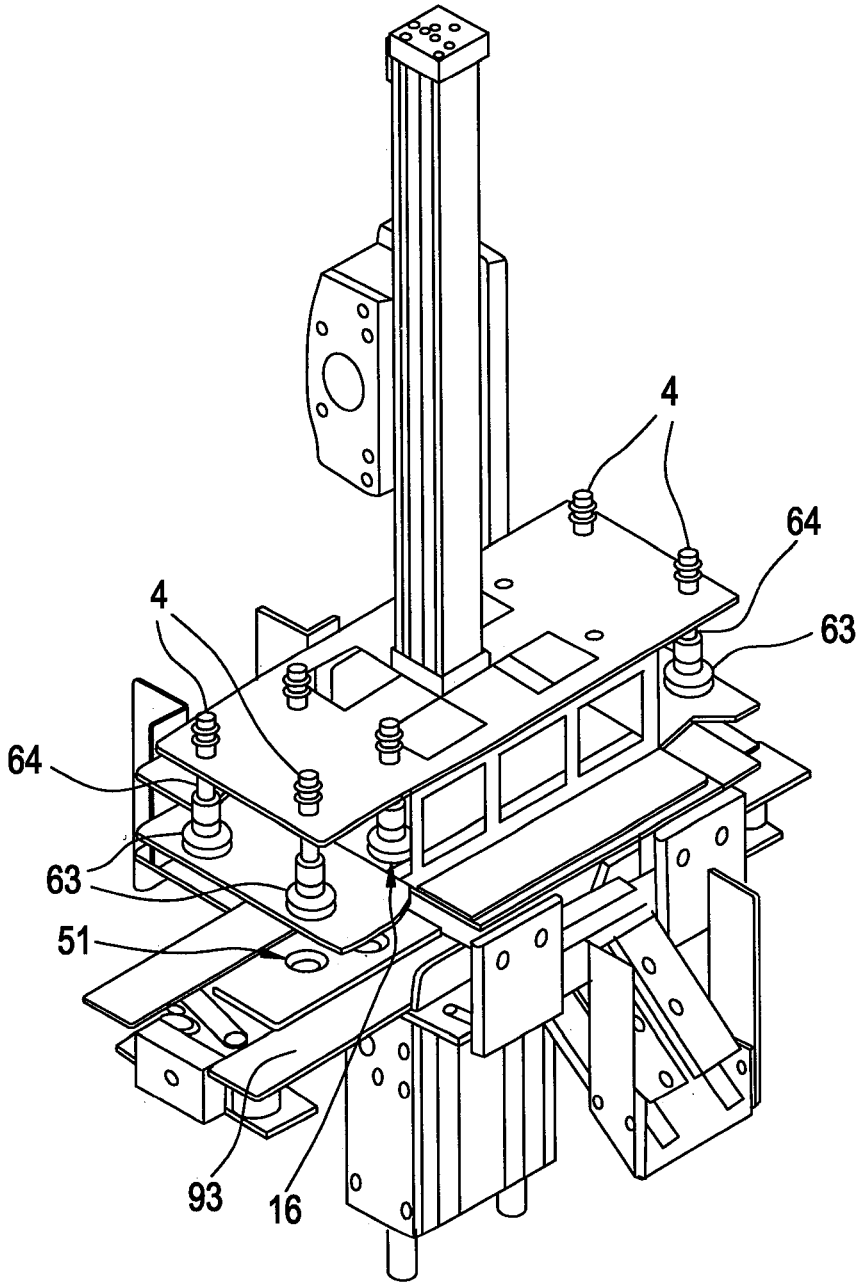
FIG. 12*b* shows a perspective view of the structure shown in FIG. 12*a*.
Figure 13:
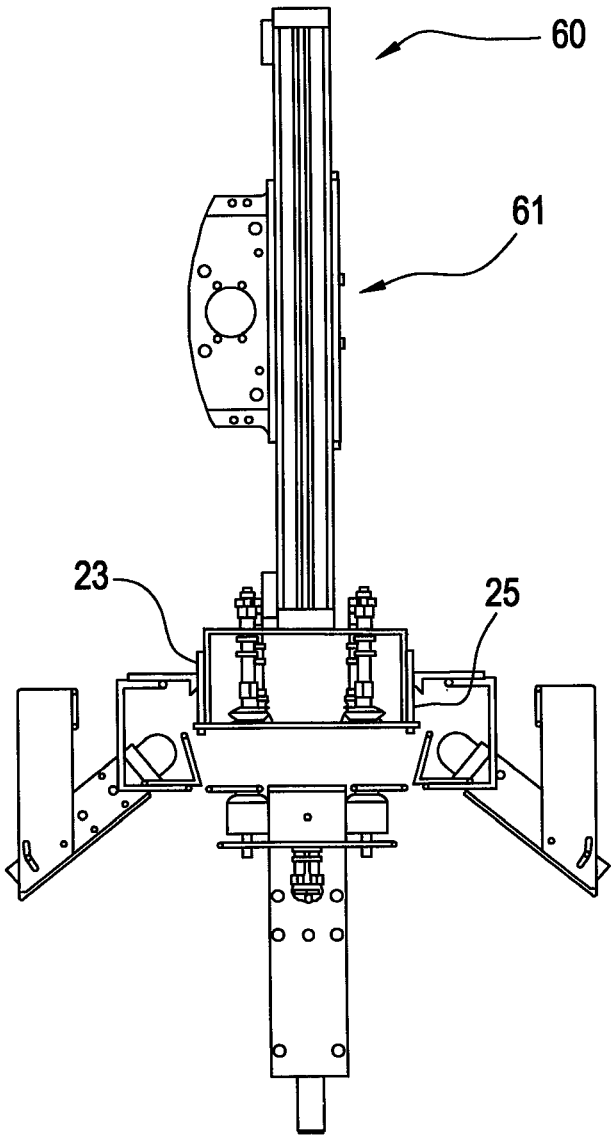
FIG. 13 shows the portion of the assembly line shown in FIG. 12 but in a different configuration during the folding process.
Figure 14:
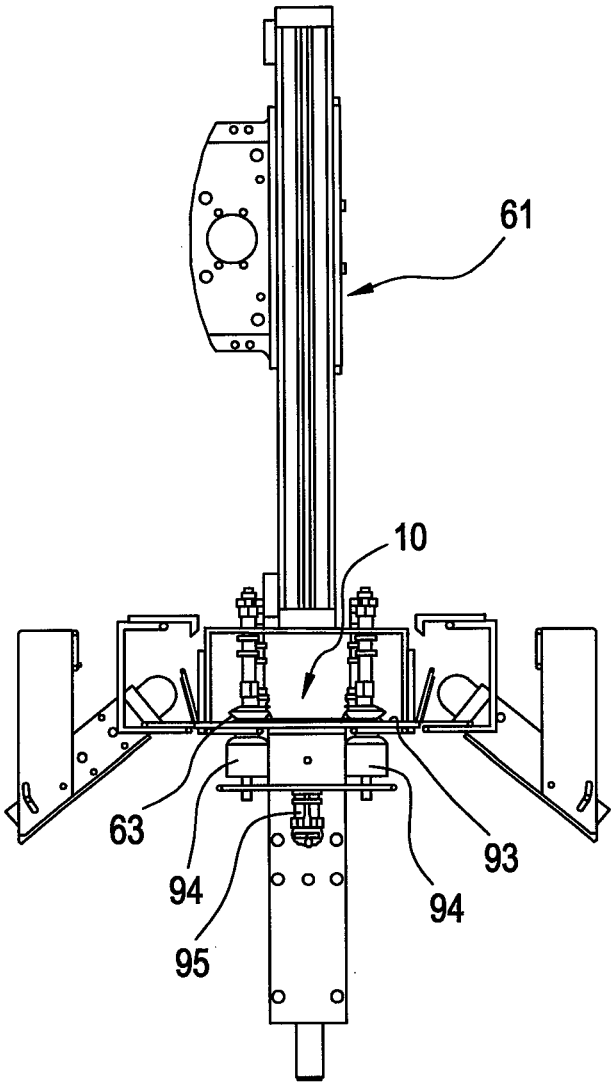
FIG. 14 shows a still further view of the portion of the assembly line shown in FIGS. 12 and 13 showing a further orientation.
Figure 15:
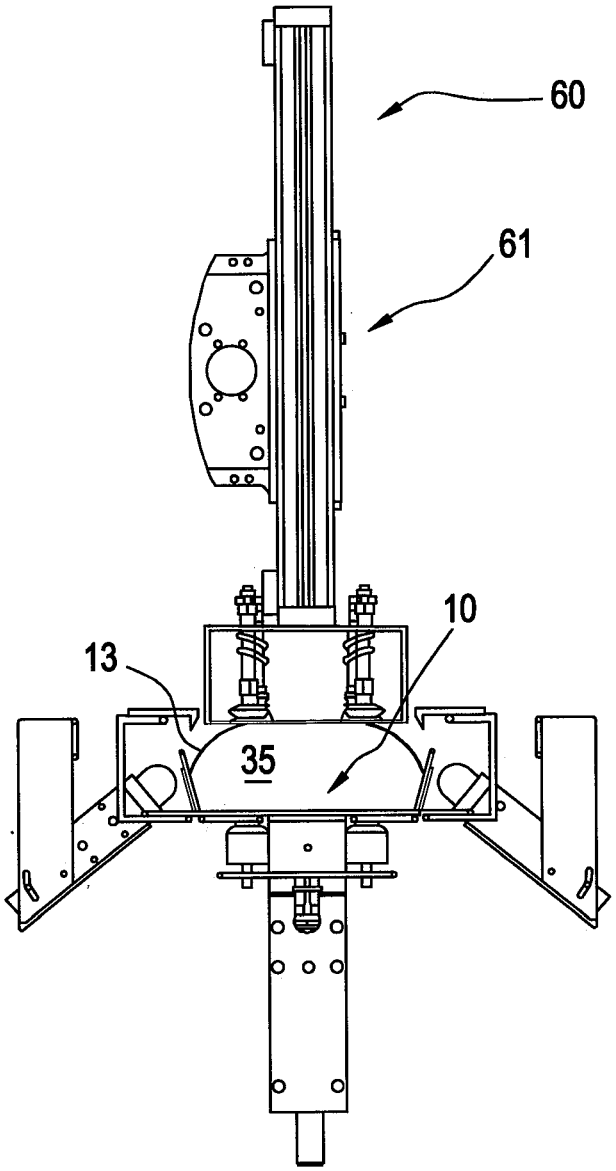
FIG. 15 shows a yet further view of the portion of the assembly line shown in FIGS. 12-14 showing a further orientation of that portion.

In FIGS. 12*a* and 12*b*, the actuator 60 has lifted an insert 10 from the magazine 51, has indexed rightward in the view of FIG. 11, and is now lowered just above the folding mechanism 90. The suction cups 63 have been activated by a source of vacuum 4 through the supply lines 64 to hold the insert 10 in place. The folding mechanism includes horizontal walls 91 which are seen in FIG. 12 to be lying under the insert 10 and extend inwardly toward one another just outside the creases 15, 17 of the insert 10. With reference to FIG. 13, the ram 61 has lowered a slight amount causing the flaps 23 and 25 of the insert to be bent upward as shown. FIG. 14 shows the ram 61 having moved downward a further amount so that the insert 10 is now lying against the plate 93 seen in FIGS. 12*a* and 12*b*. The suction cups 63 are deactivated at the same time as suction cups 5 are activated to firmly hold the insert 10 in place on the plate 93. Suction cups 6 (FIG. 12*b*) are activated to grasp the film 13. Reference numeral 94 is directed to stoppers that underlie the wall 93 to support it.

Figure 16:
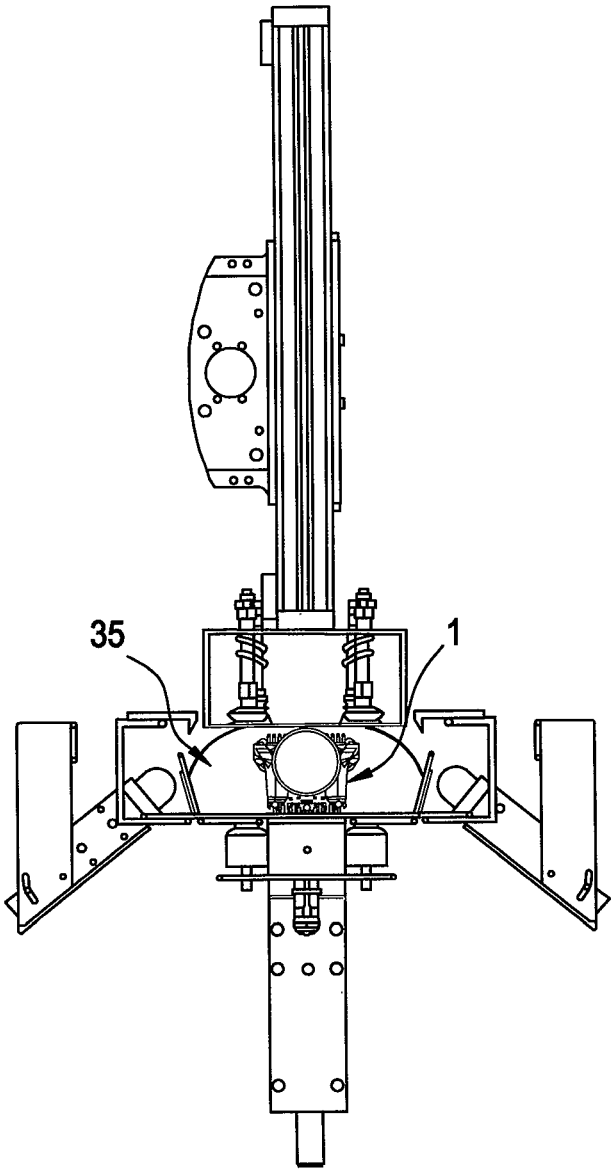
FIG. 16 shows a view similar to that of FIG. 15 but with a product inserted within the chamber of the flat retention insert.

The vacuum lines 95 shown in FIG. 14 in particular connect to additional suction cups 5 adjacent the stoppers 94 (FIG. 12*b*) which hold the insert 10 against the plate 93. Thus, with reference to FIG. 15, with the suction cups 5 supplied by the vacuum lines 95 holding the insert 10 against the plate 93 and suction cups 6 holding the film 13 to device 62, and the ram 61 is lifted to lift the film 13 from the base of the insert 10, thereby creating the chamber 35 also seen with reference in particular to FIG. 4. With reference to FIG. 16, a product 1 may then be placed within the chamber so formed.

Figure 17:
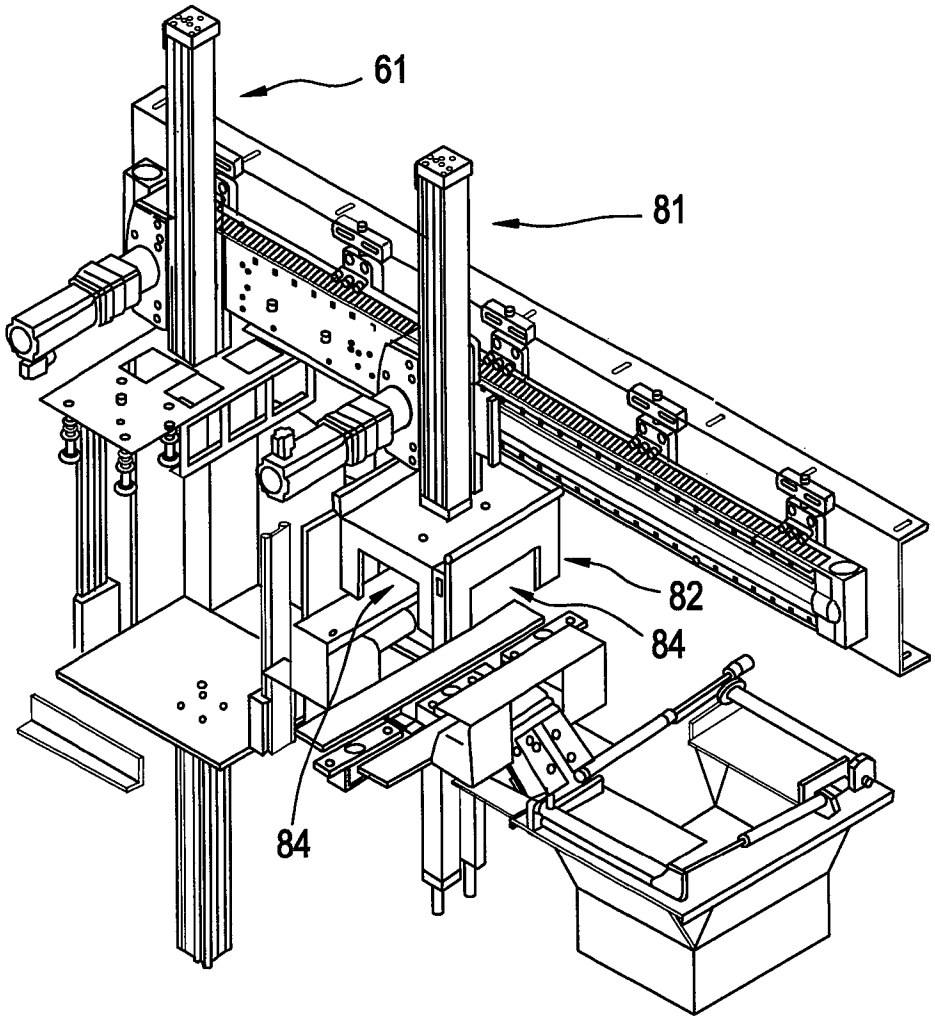
FIG. 17 shows a perspective view of the assembly line showing the third station where the product inserted within the flat retention insert is placed within a shipping container.

Once these steps have been carried out, with reference to FIG. 17, the ram 61 is lifted and the rams 61 and 81 are indexed leftward in the view of FIG. 17 so that the pick and place end of arm tooling 82 is now suspended over the insert 10 with the product 1 contained therein.

Figure 18:
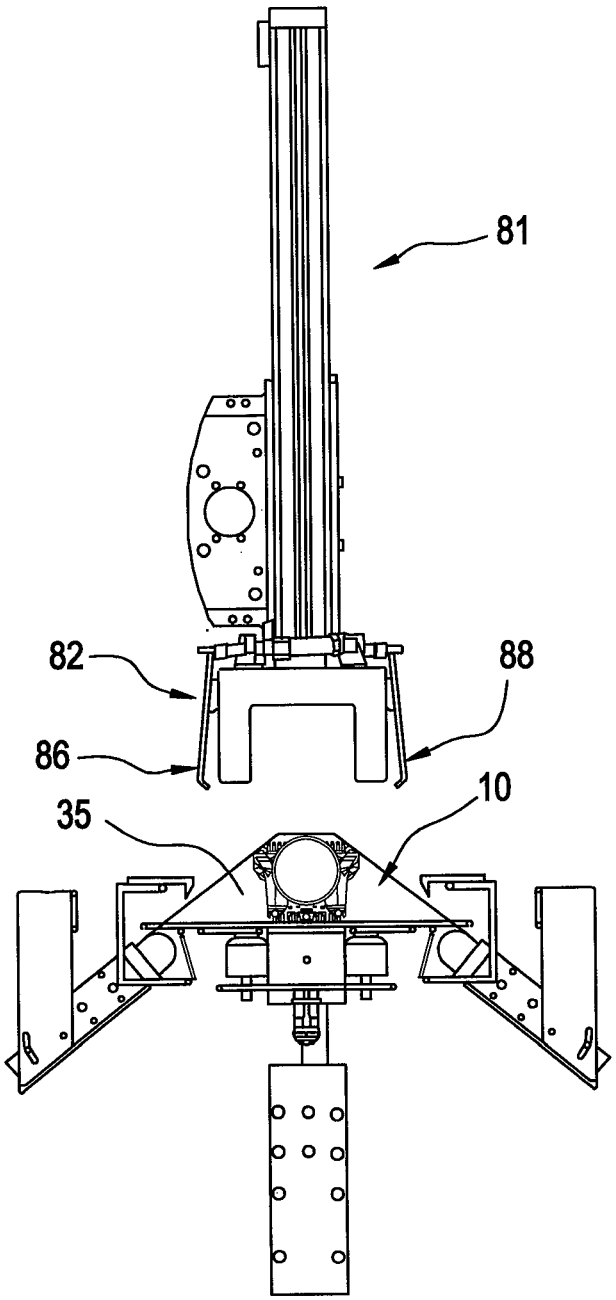
FIG. 18 shows the station of the assembly line shown in FIGS. 12-16 but with the components reoriented so that a device may be lowered to facilitate lifting the packaged product to be moved to a location where it may be placed in a shipping container.
Figure 19:
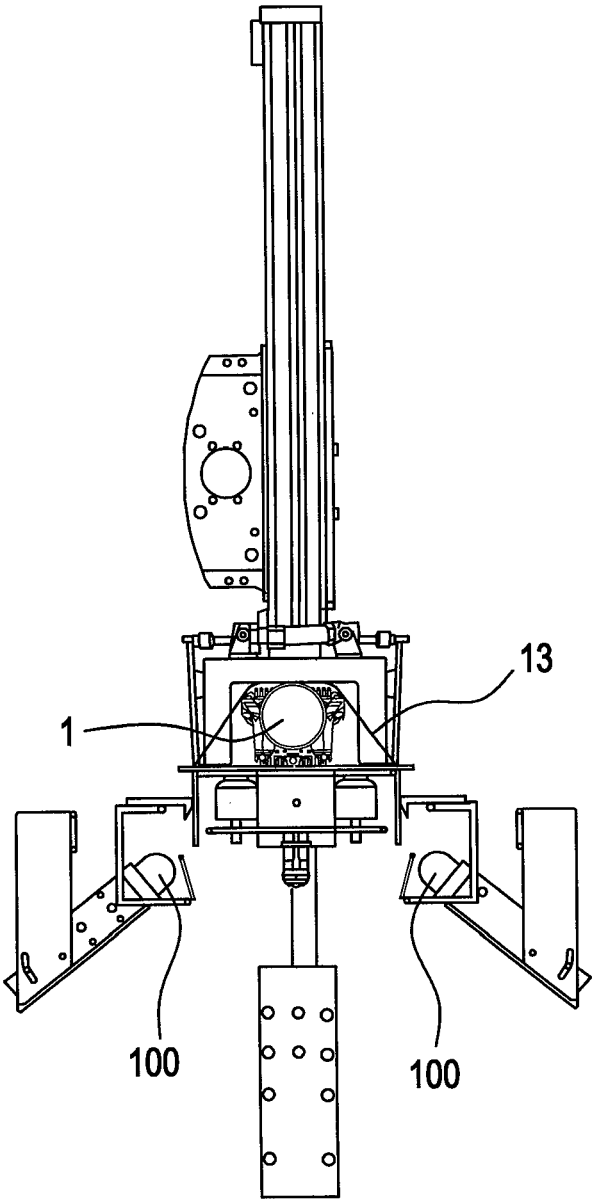
FIG. 19 shows a view similar to that of FIG. 18 but with the folding mechanism extended to lift the insert and product into place so that the implement may surround them.

Now, with reference to FIG. 18, the ram 81 suspends the tooling 82 over the insert 10 with the product 1 contained therein. The bent plates 86 and 88 of tooling 82 are shown in the open receiving position. With reference to FIG. 19, the ram 81 lowers the tooling 82 until it encloses the insert 10 and product. With reference back to FIG. 17, it is seen that the tooling 82 includes cutouts 84 on its four sides so that it can surround the insert 10 and product 1 without damaging the film 13 or base of the insert 10. Once the tooling is surrounding the insert 10, it may be lifted by elevating the ram 81.

Figure 2:
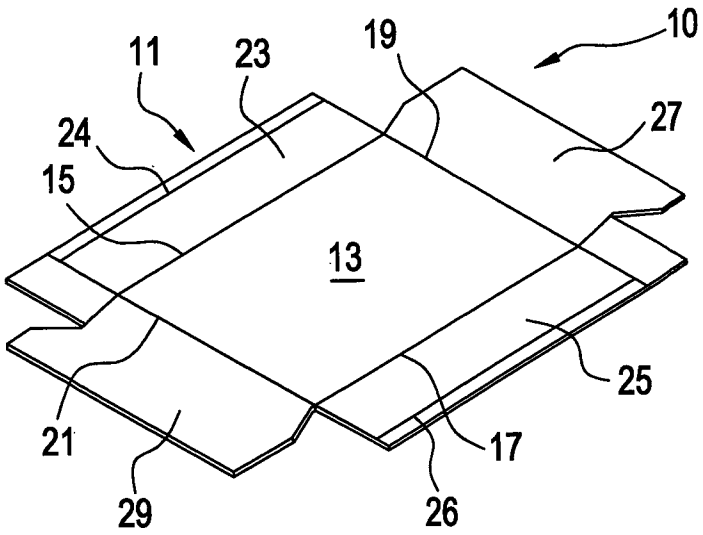
FIG. 2 PRIOR ART
FIG. 2 shows a perspective view of the flat retention insert shown in FIG. 1.
Figure 1:
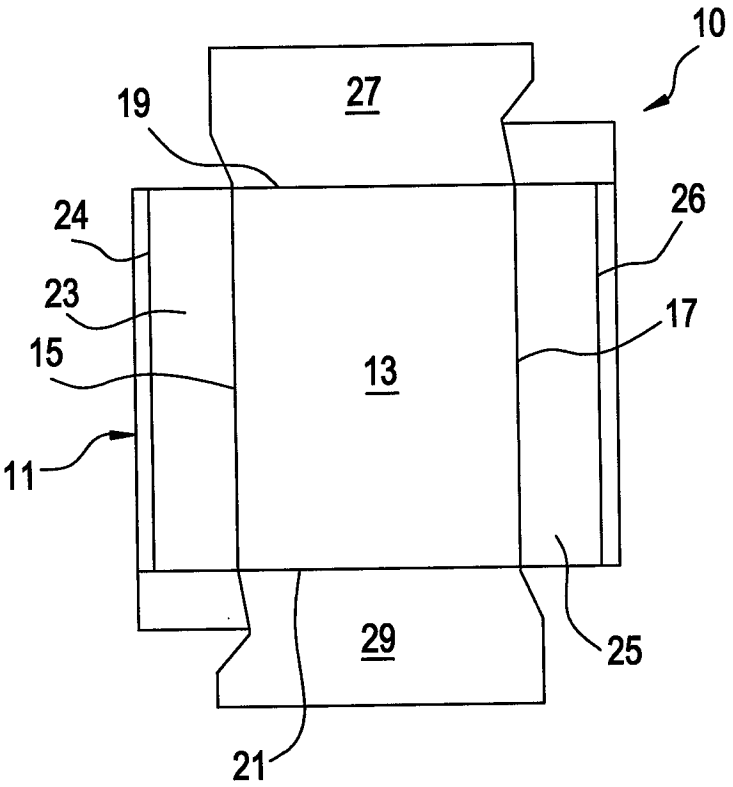
FIG. 1 PRIOR ART
FIG. 1 shows a top view of a flat retention insert known in the prior art.
Figure 3:
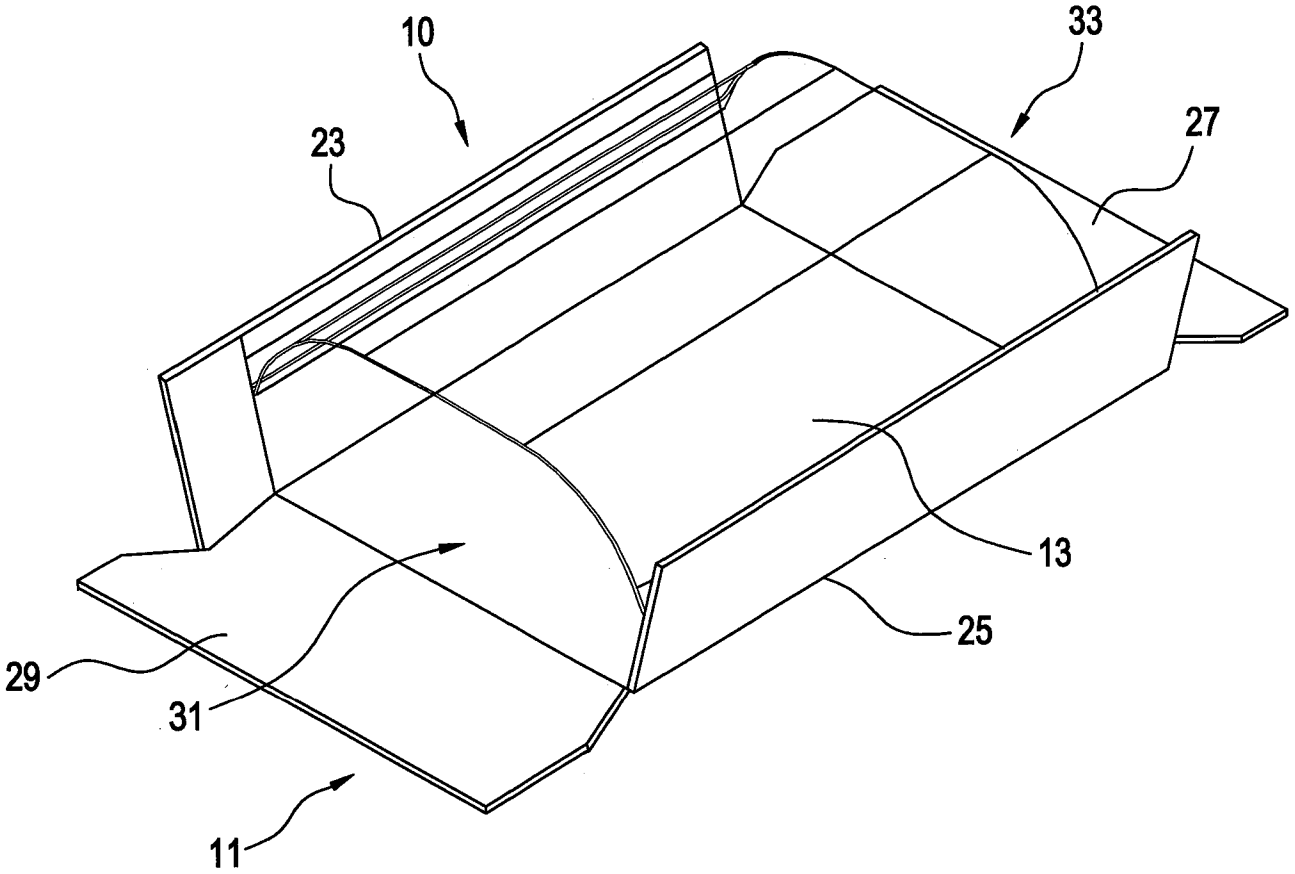
FIG. 3 PRIOR ART
FIG. 3 shows a perspective view of the flat retention insert with flaps raised to expose a chamber beneath a plastic film thereof.
Figure 5:
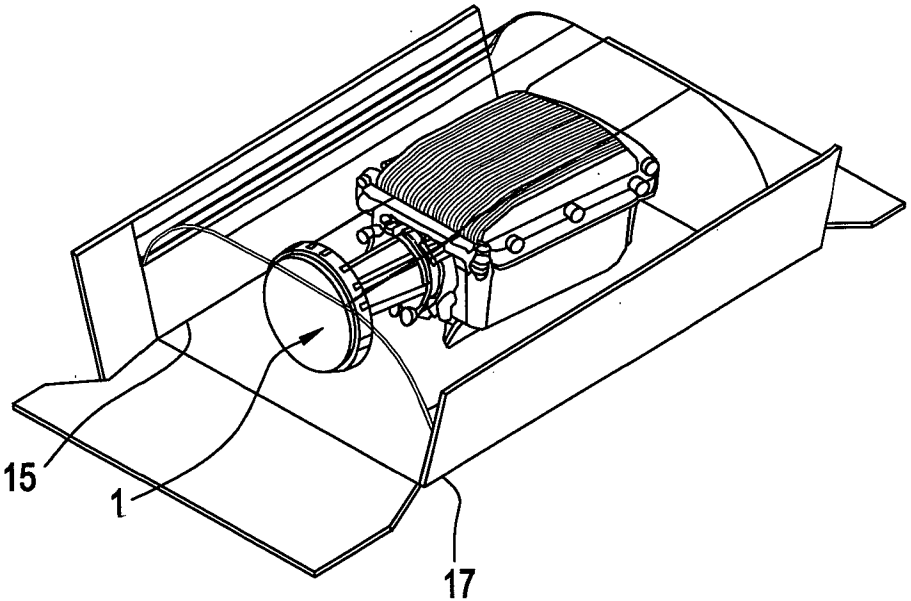
FIG. 5 PRIOR ART
FIG. 5 shows a perspective view of the orientation shown in FIG. 4.
Figure 4:
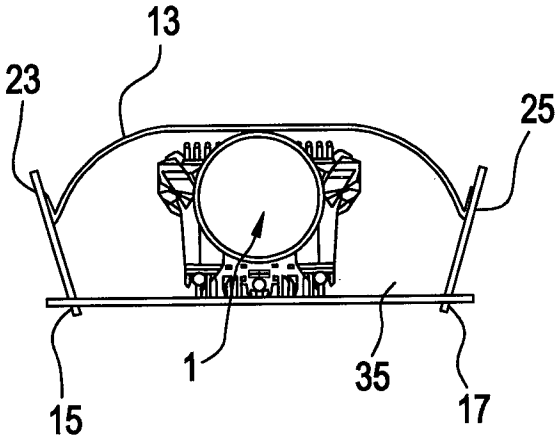
FIG. 4 PRIOR ART
FIG. 4 shows an end view of a flat retention insert with a product placed within the chamber.
Figure 7:
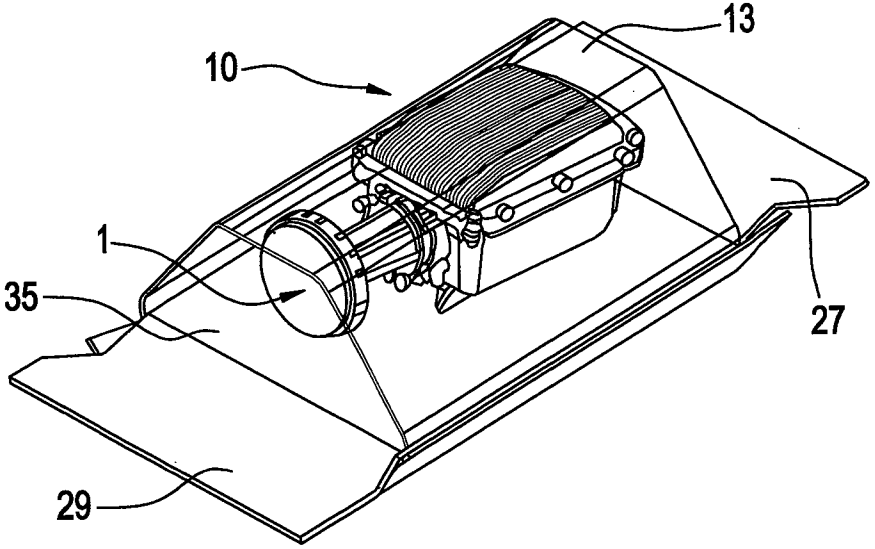
FIG. 7 PRIOR ART
FIG. 7 shows a perspective view of the orientation shown in FIG. 6.
Figure 6:
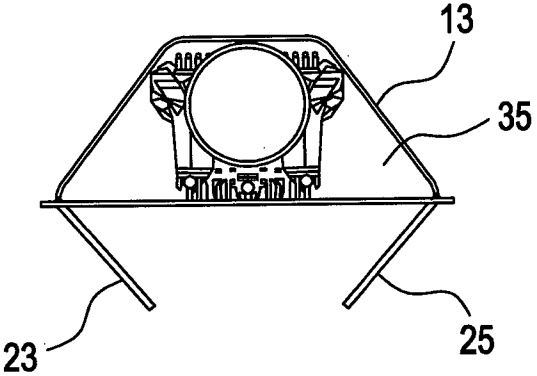
FIG. 6 PRIOR ART
FIG. 6 shows an end view of the flat retention insert with flaps bent downwardly to stretch a film over the product.
Figure 9:
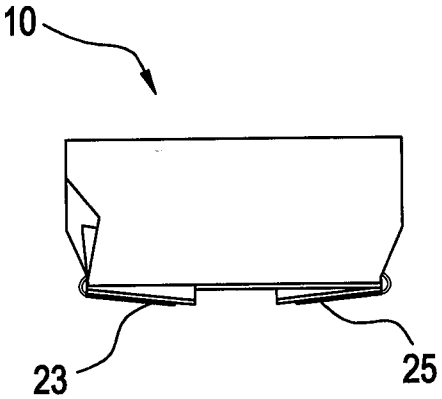
FIG. 9 PRIOR ART
FIG. 9 shows an end view of the flat retention insert with other flaps folded upwardly.
Figure 8:
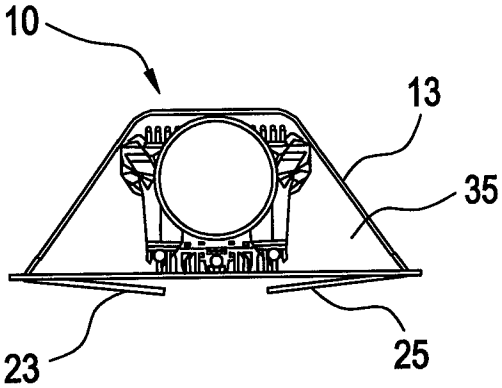
FIG. 8 PRIOR ART
FIG. 8 shows an end view with the flaps folded further under the middle of the flat retention insert.
Figure 10:
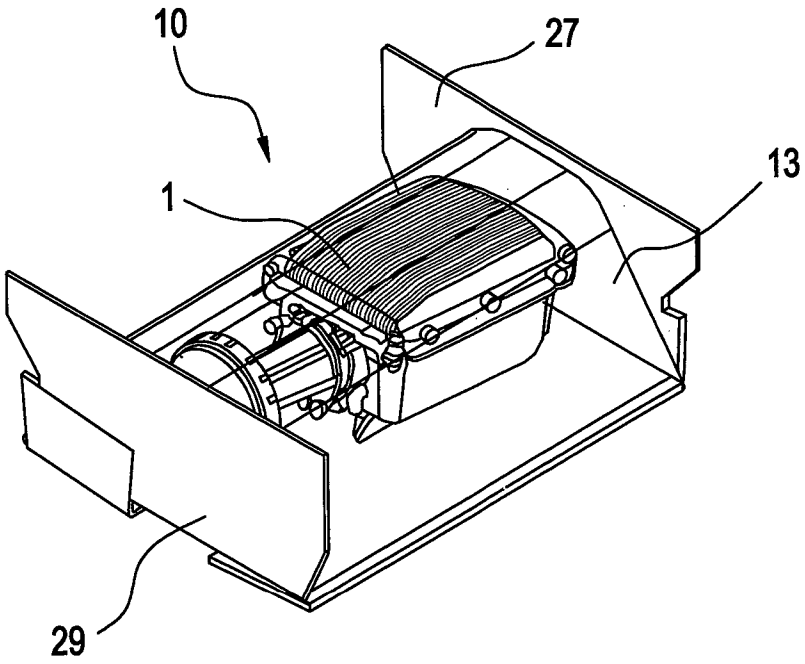
FIG. 10 PRIOR ART
FIG. 10 shows a perspective view of the orientation of the flat retention insert shown in FIG. 9.
Figure 20:
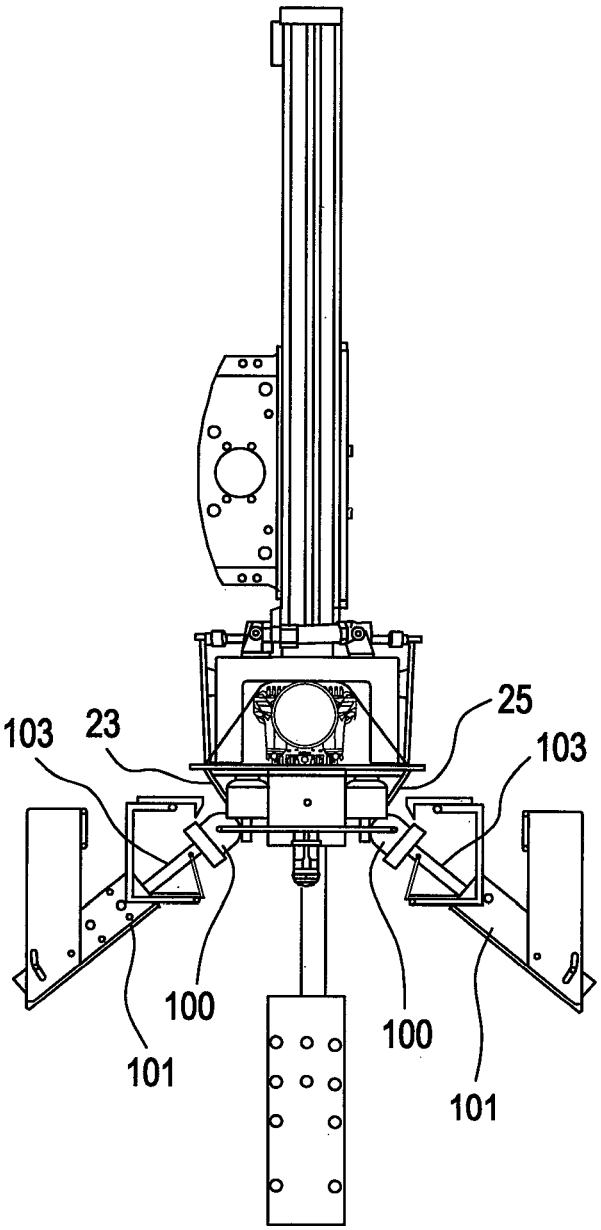
FIG. 20 shows a view similar to FIG. 19 but with the insert and product firmly captured within the implement.
Figure 21:
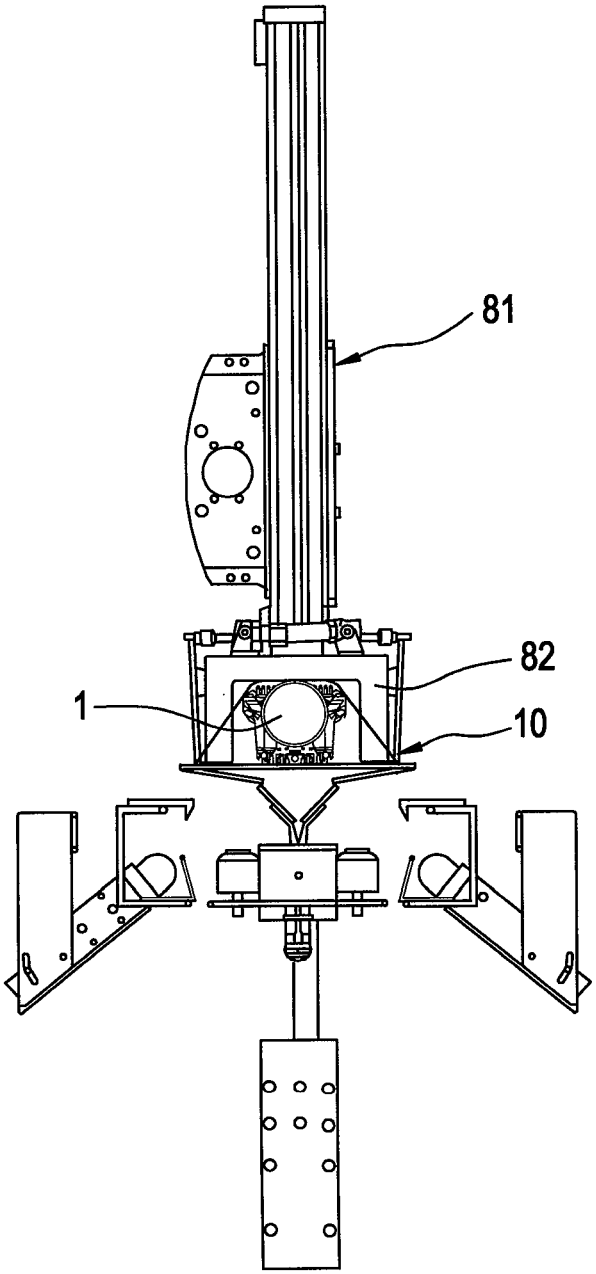
FIG. 21 shows a view similar to that of FIG. 20 but with the implement lifted with the insert and product contained therewithin and the folding mechanism retracted, depicting the articulated side panels of a plate to avoid interference with the folded insert.

With reference to FIG. 20, the devices 100 are extended out by virtue of the rams 101 and the support shafts 103 to engage the flaps 23 and 25 and bend them upwardly to the position also shown in FIG. 6. Further movement of the support shafts 103 causes the flaps 23 and 25 to assume the orientation shown in FIG. 21 and also in FIG. 8. Bent plates 86 and 88 (FIG. 18) are shown in FIG. 20 in the closed position to grip the folded insert 10 with the product 1 contained so that the insert 10 and product 1 may be lifted by the ram 81 and tooling 82.

Figure 22:
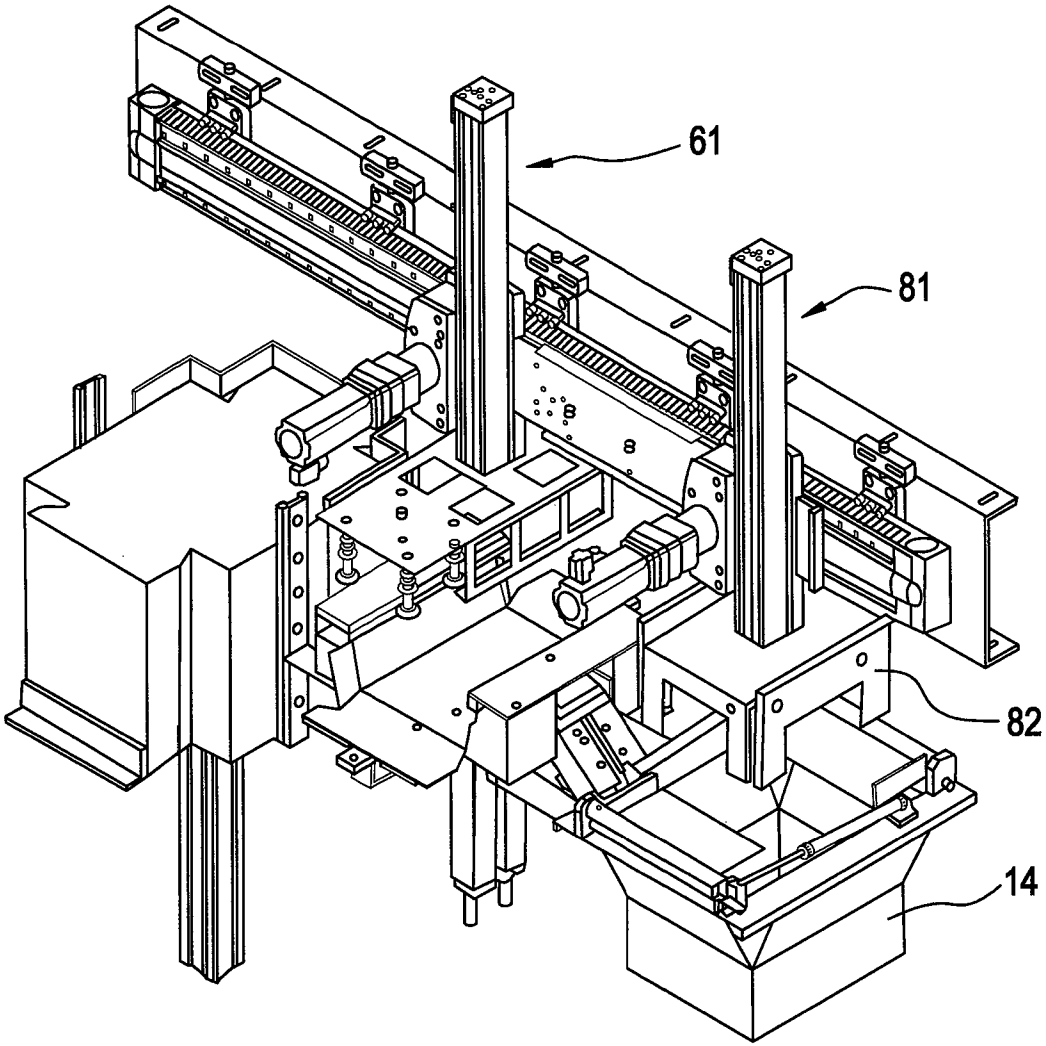
FIG. 22 shows the implement and its ram after being lifted and moved to the third station where a shipping container is located.
Figure 23A:
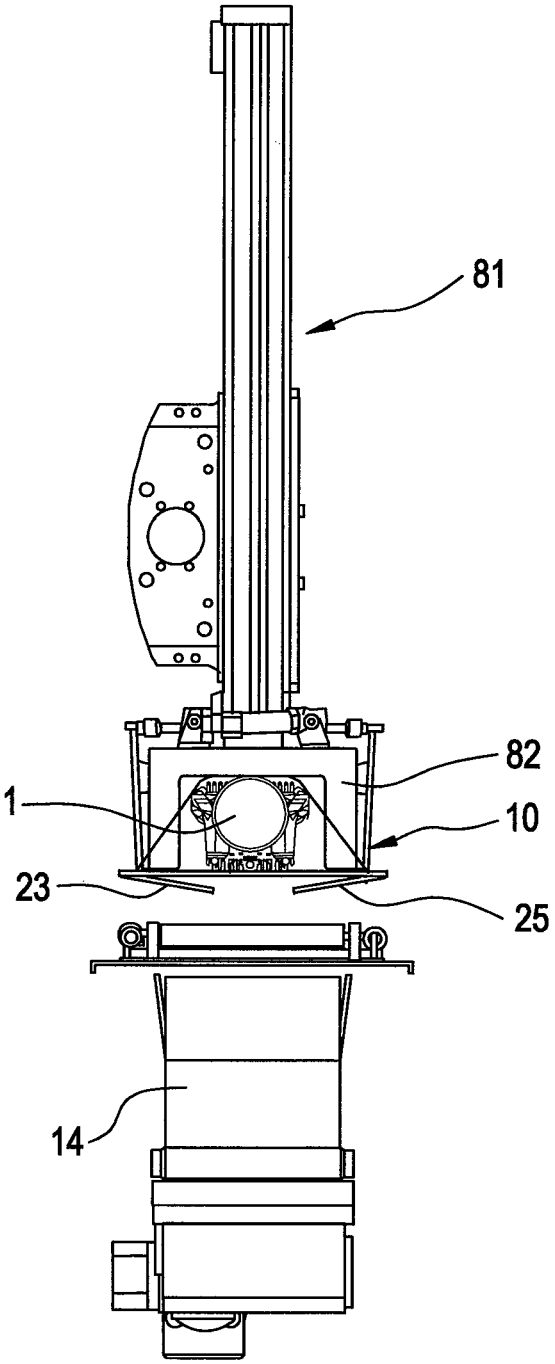
FIG. 23*a* shows an end view of the implement suspended over the shipping container.
Figure 23B:
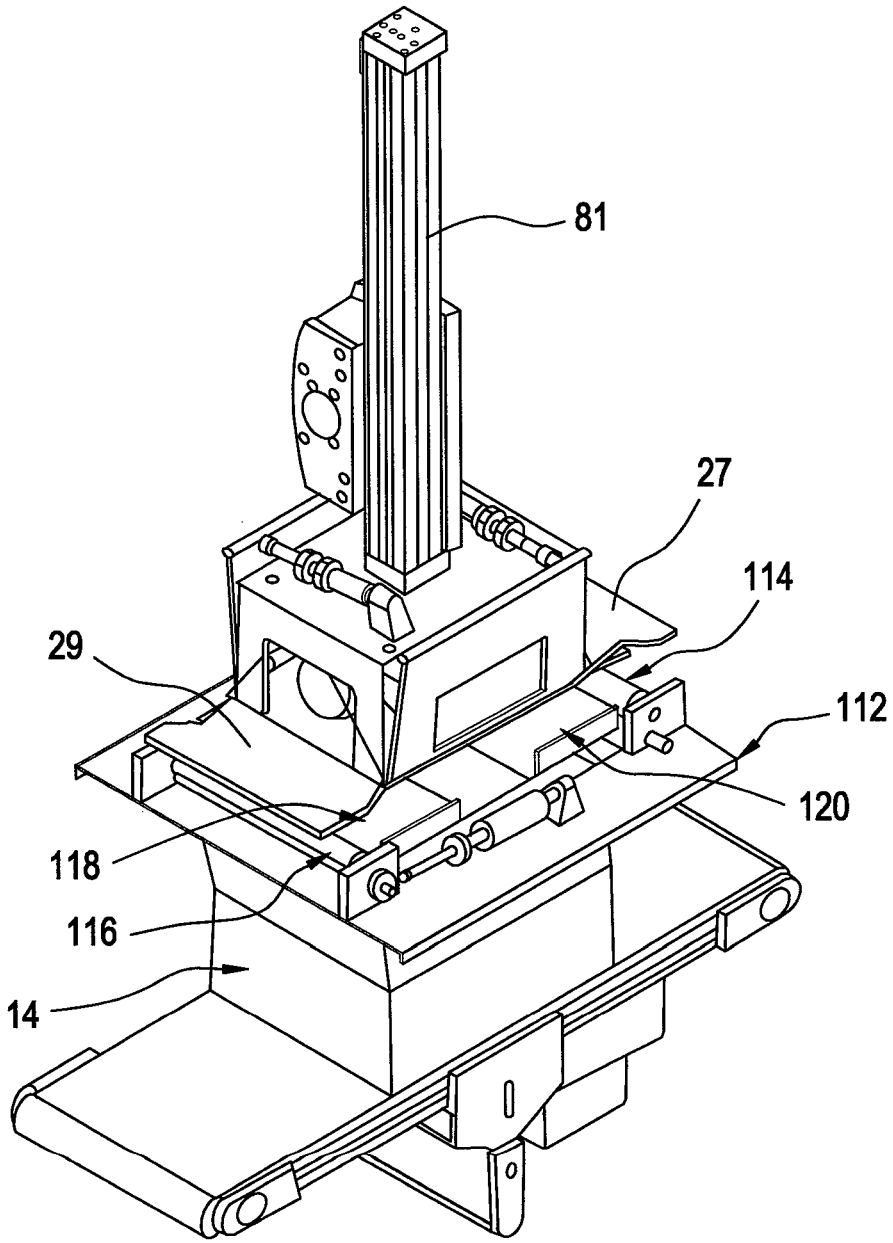
FIG. 23*b* shows a perspective view of the structure shown in FIG. 23*a*.

Thereafter, the ram 81 may lift the tooling 82 with the insert 10 and product 1 captured therein. With reference to FIG. 22, the ram 81 and ram 61 are indexed together in the right-hand direction in the view of FIG. 22 until the tooling 82 with the insert and product captured therein are suspended above the container 14. This is also shown in the side view of FIG. 23*a*. In FIGS. 23*a* and 23*b*, the frame 112 supports rollers 114 and 116. As the ram lowers the insert 10 toward the container 14, the rollers 114 and 116 engage the flaps 27 and 29 and fold them up to cover the openings 33, 31 at each end of the film 13. Box locating plows 118 and 120 are actuated to secure the shipping container 14 in place.

Figure 24:
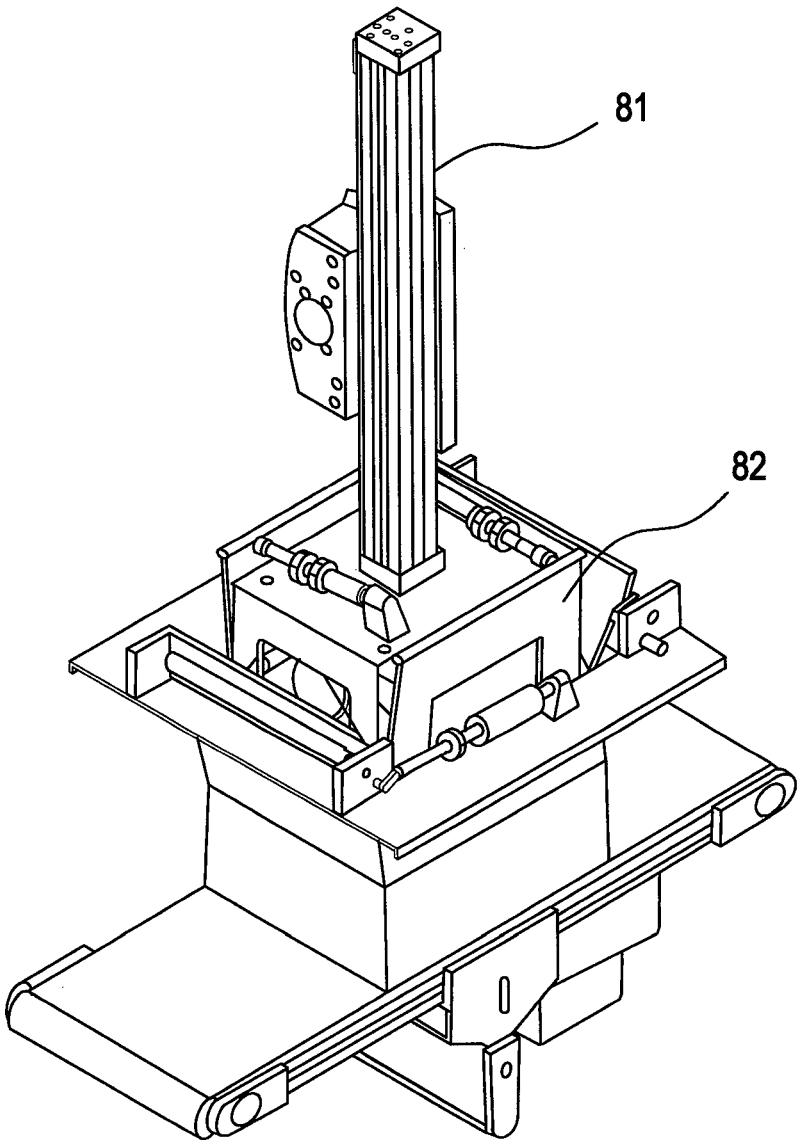
FIG. 24 shows a perspective view of the implement lowering the insert and product into the shipping container.
Figure 25:
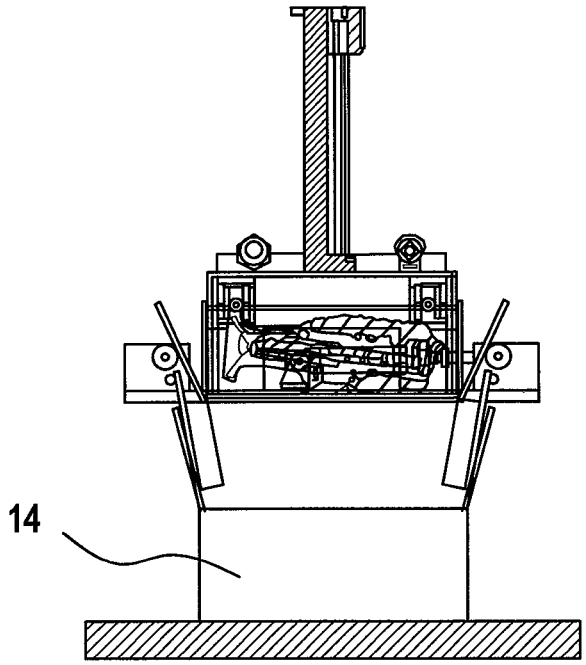
FIG. 25 shows a side view of the implement in a position lowering the product into the shipping container.
Figure 26:
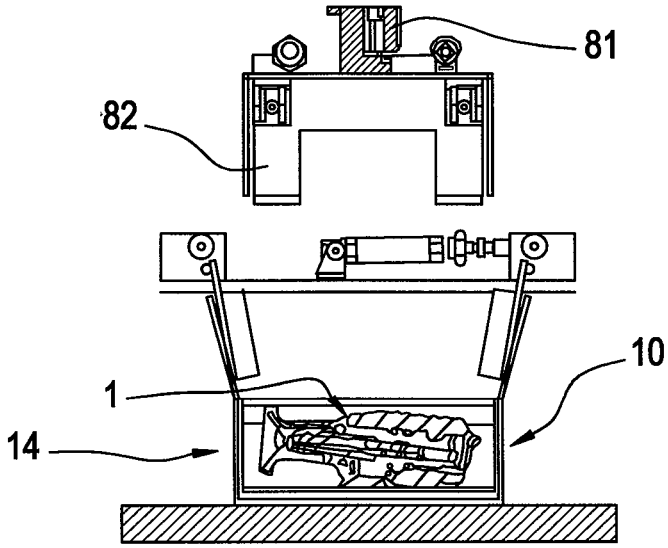
FIG. 26 shows the insert and product within the shipping container and the implement lifted off.

With reference to FIGS. 24 and 25, the ram 81 lowers the tooling 82 with the insert and product captured therein into the container 14. Again, box locating plows 118 and 120 hold the shipping container 14 in place, as seen in FIG. 25. Rollers 114 and 116 complete the fold on flaps 27 and 29 of insert 10 as the ram 81 lowers the insert 10 and product 1 through the frame 112 into the shipping container 14. As shown in FIG. 26, once the insert and product are within the container 14, the ram 81 is activated to lift the tooling away.

Then, the rams 61 and 81 are indexed on the slide rail 57 in the left-hand direction until they return to their configuration shown in FIG. 11. At that point, the method is repeated with the next insert 10.

In this way, the method of packaging a product using a flat retention insert may be automated for enhanced efficiency, reduced repetitive injuries to employees, and reduced costs and increased profitability.

As such, an invention has been disclosed in terms of a preferred embodiment thereof which fulfills each and every one of the objects of the invention as set forth hereinabove, and provides a new and useful method of automating filling and packaging of flat retention inserts of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A method of automating filling of flat retention inserts comprising the steps of:

a) providing at least one flat retention insert including:
   i) a body to which is adhered a film;
   ii) said film being adhered on sides thereof, with opposed ends of said film being unadhered; and
   iii) said body having a flap adjacent each adhered side of said film, each flap being bendable with respect to a remainder of said body;
   iv) whereby bending said flaps upwardly allows said film to bow upwardly creating an opening at each end of said film and a chamber between said film and said body;

b) providing an assembly line for automating filling of flat retention inserts including;
   i) an actuator with a reciprocating ram;
   ii) a first station with a magazine for storing said at least one flat retention insert;
   iii) a second station laterally spaced from said first station and comprising a folding mechanism for manipulating said flat retention insert to bend said flaps in a first direction to open said chamber, facilitate insertion of a product into said chamber and bend said flaps in a second opposite direction to stretch said film over said product;

c) moving said actuator to a position over said magazine;

d) lowering said ram toward said magazine, a distal end of said ram having a gripping mechanism for releasably gripping a flat retention insert;

e) gripping a flat retention insert using said gripping mechanism;

f) lifting said ram with a flat retention insert gripped by said gripping mechanism;

g) moving said actuator to a position over said second station;

h) lowering said ram toward said folding mechanism;

i) said gripped flat retention insert engaging said folding mechanism, whereby further lowering of said ram causes said flaps to engage walls of said folding mechanism to bend said flaps upward;

j) said folding mechanism holding a body of said flat retention insert in place with said flaps bent upward while gripping said film, and said ram raising to lift said film and open said chamber;

k) inserting a product into said chamber;

l) lifting said ram with said folding mechanism bending said flaps downward to stretch said film over said product; and m) conveying said flat retention insert and said product to a shipping container.

2. The method of claim 1, wherein said gripping mechanism comprises at least one suction cup fluidly connected to a controllable source of vacuum.

3. The method of claim 2, wherein said step of said folding mechanism holding said body in place is carried out by a further suction cup connected to a further controllable source of vacuum.

4. The method of claim 1, wherein said actuator comprises a first actuator and said ram comprises a first ram, and further comprising a second actuator carrying a second ram having a distal end to which is mounted a pick and place end sized to surround said flat retention insert with said product within the chamber thereof, said pick and place end gripping said flat retention insert, whereupon said second ram is lifted to lift said pick and place end up from said folding mechanism with said product contained within said flat retention insert.

5. The method of claim 4, further including a third station laterally spaced from said second station, said third station supporting a shipping container.

6. The method of claim 5, wherein when said pick and place end and said second ram are lifted, they are shifted laterally until said pick and place end is suspended over said shipping container, whereupon said second ram is lowered to lower said product and said flat retention insert into said shipping container.

7. The method of claim 5, wherein when said first actuator is aligned over said second station, said second actuator is aligned over said third station.

8. The method of claim 4, wherein said first actuator and second actuator are constrained to move laterally in unison.

9. The method of claim 8, wherein when said first actuator is aligned over said first station, said second actuator is aligned over said second station.

10. The method of claim 8, wherein said first and second actuators are mounted on a linear slide rail.

11. The method of claim 4, wherein said pick and place end has plural side openings.

12. The method of claim 1, wherein said body is made of cardboard.

13. The method of claim 12, wherein said film is transparent.

14. The method of claim 1, wherein said at least one flat retention insert comprises a plurality of flat retention inserts.

15. The method of claim 1, wherein said at least one flat retention insert includes two additional flaps that may be bent upward after said product has been inserted into said chamber to cover said openings.

16. A method of automating filling of flat retention inserts comprising the steps of:

a) providing at least one flat retention insert including:
   i) a cardboard body to which is adhered a transparent film;
   ii) said film being adhered on sides thereof, with opposed ends of said film being unadhered; and
   iii) said body having first flaps adjacent each adhered side of said film, and second flaps perpendicular to said first flaps, each flap being bendable with respect to a remainder of said body;
   iv) whereby bending said first flaps upwardly allows said film to bow upwardly creating an opening at each end of said film where said second flaps are located, and creating a chamber between said film and said body;

b) providing an assembly line for automating filling of flat retention inserts including;
   i) an actuator with a reciprocating ram;
   ii) a first station with a magazine for storing said at least one flat retention insert;
   iii) a second station laterally spaced from said first station and comprising a folding mechanism for manipulating said flat retention insert to bend said first flaps in a first direction to open said chamber, facilitate insertion of a product into said chamber and bend said flaps in a second opposite direction to stretch said film over said product;

c) moving said actuator to a position over said magazine;

d) lowering said ram toward said magazine, a distal end of said ram having a gripping mechanism comprising at least one suction cup for releasably gripping a flat retention insert;

e) gripping a flat retention insert using said gripping mechanism;

f) lifting said ram with a flat retention insert gripped by said gripping mechanism;

g) moving said actuator to a position over said second station;

h) lowering said ram toward said folding mechanism;

i) said gripped flat retention insert engaging said folding mechanism, whereby further lowering of said ram causes said first flaps to engage walls of said folding mechanism to bend said flaps upward;

j) said folding mechanism holding a body of said flat retention insert in place with said first flaps bent upward while gripping said film, and said ram raising to lift said film and open said chamber;

k) inserting a product into said chamber;

l) lifting said ram with said folding mechanism bending said first flaps downward to stretch said film over said product; and m) conveying said flat retention insert and said product to a shipping container.

17. The method of claim 16, wherein said step of said folding mechanism holding said body in place is carried out by a further suction cup connected to a further controllable source of vacuum.

18. The method of claim 16, wherein said actuator comprises a first actuator and said ram comprises a first ram, and further comprising a second actuator carrying a second ram having a distal end to which is mounted a pick and place end sized to surround said flat retention insert with said product within the chamber thereof, said pick and place end gripping said flat retention insert, whereupon said second ram is lifted to lift said pick and place end up from said folding mechanism with said product contained within said flat retention insert.

19. The method of claim 18, further including a third station laterally spaced from said second station, said third station supporting a shipping er wherein when said pick and place end and said second ram are lifted, they are shifted laterally until said pick and place end is suspended over said shipping container, whereupon said second ram is lowered to first cause said second flaps to bend upward and then further lower said product and said flat retention insert into said shipping container.

20. The method of claim 19, wherein said first actuator and second actuator are constrained to move laterally in unison, whereby when said first actuator is aligned over said first station, said second actuator is aligned over said second station, and when said first actuator is aligned over said second station, said second actuator is aligned over said third station.

* * * * *